United States Patent [19]

Akkerman

[11] Patent Number: 4,641,707

[45] Date of Patent: Feb. 10, 1987

[54] WELL APPARATUS

[75] Inventor: Neil H. Akkerman, Houston, Tex.

[73] Assignee: AVA International Corporation, Houston, Tex.

[21] Appl. No.: 663,713

[22] Filed: Oct. 22, 1984

[51] Int. Cl.[4] ..... E21B 33/12; E21B 34/10

[52] U.S. Cl. ..... 166/116; 166/126; 166/133; 166/143; 166/324; 166/332

[58] Field of Search ..... 166/72, 106, 115, 116, 166/126, 129, 133, 142, 143, 145, 148, 152, 188, 183, 321, 324, 332, 334

[56] References Cited

U.S. PATENT DOCUMENTS

| | | | |
|---|---|---|---|
| 2,971,581 | 2/1961 | Reglin | 166/148 |
| 2,984,303 | 5/1961 | Baker | 166/126 |
| 3,040,811 | 6/1962 | Pistole et al. | 166/133 |
| 3,375,874 | 4/1968 | Cherry et al. | 166/148 |
| 3,967,647 | 7/1976 | Young | 766/321 |
| 4,031,955 | 6/1977 | Ledet | 166/188 |
| 4,376,464 | 3/1983 | Crow | 166/324 |
| 4,407,363 | 10/1983 | Akkerman | 166/332 |
| 4,452,311 | 6/1984 | Speegle et al. | 166/324 |

FOREIGN PATENT DOCUMENTS

| | | | |
|---|---|---|---|
| 673757 | 7/1979 | U.S.S.R. | 166/106 |

*Primary Examiner*—James A. Leppink
*Assistant Examiner*—Hoang C. Dang
*Attorney, Agent, or Firm*—Vaden, Eickenroht, Thompson & Boulware

[57] ABSTRACT

Well apparatus is disclosed in which the bore through a lower tubular body adapted to be packed off and anchored within a well bore is opened and closed by a flapper pivotally mounted on the lower body and spring pressed toward closed position, and a flow tube mounted for reciprocation within the bore of an upper tubular body releasably connected to the lower body extends downwardly through the bore of the upper and lower bodies to a position for engaging and moving the flapper to open position, as the flow tube is lowered by means of control fluid supplied to a pressure responsive operator connected to the flow tube, and permitting the flapper to close as the control fluid is exhausted from the operator.

21 Claims, 15 Drawing Figures

WELL APPARATUS

Figure 1:
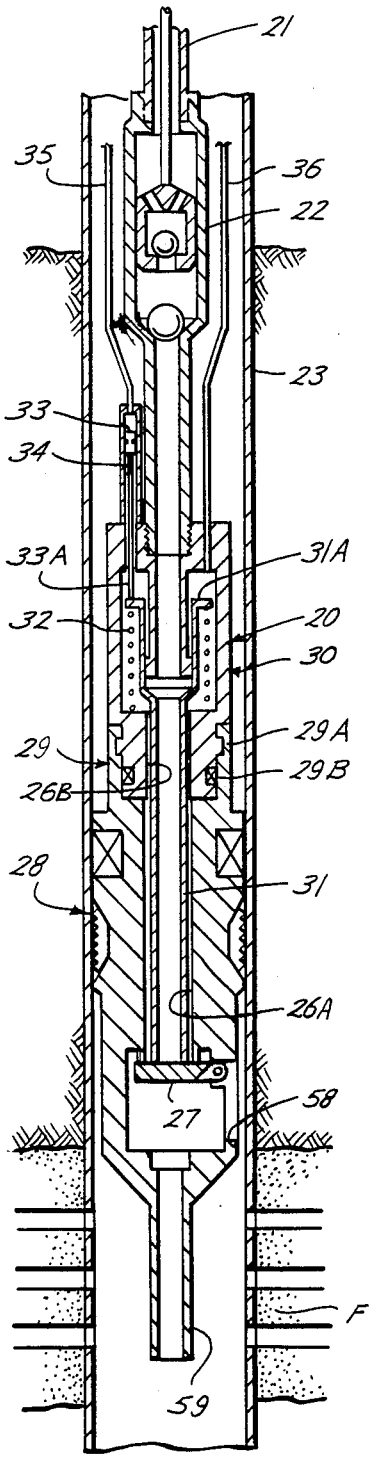

This invention relates generally to improvements in apparatus for use in controlling the flow of well fluid through a production tubing string in response to the supply and exhaust of hydraulic fluid to and from means for operating a closure member for opening and closing the bore of tubular body means forming a continuation of the string. In one of its aspects, it relates to improvements in apparatus of this type for use in establishing control over flow within the annulus about the tubing string of an existing well when, for example, well fluid is pumped upwardly therethrough by means of a downhole pump in the lower end of the string. In another of its aspects, it relates to improvements in a remotely controlled, subsurface safety valve of the type which includes a closure element such as a flapper which is mounted in the bore of the body means and yieldably urged toward a position closing a seat about the bore, and actuator means such as a flow tube which is responsive to the supply of hydraulic control fluid from the surface to move the flapper from closed to open position and hold it open, and which is responsive to the exhaust of control fluid therefrom to permit the flapper to close. In still another of its aspects, this invention relates to improvements in a valve of this latter type in which the actuator means is operative to equalize pressure across the closure element, before it is moved to open position, so that the force due to control fluid need not overcome the force of well fluid acting to maintain the closure element closed.

There are many wells, particularly in the West Texas area, where oil is produced by means of downhole pumps, either of the sucker rod type or electric submersible type. Often the production tubing in which the pumps operate is not packed off, so that the well casing as well as the tubing is exposed to formation fluids which may contain large amounts of $H_2S$ or other corrosive materials. As a result of this as well as the age of the wells, both the tubing and casing may be in weakened condition.

Efforts have been made to enhance the recovery of these wells by "flooding" the formation with $C0_2$ injected into one or more surrounding well bores. As the $C0_2$ is swept through the formation and into the well bore, it turns a relatively low pressure oil well into high pressure gas well, and, as a result, unanchored tubing may be blown out of the well. Also, due to the added corrosive effect of the $C0_2$, there is even a greater risk of losing production due to perforated tubing and/or casing.

For controlling the wells under these circumstances, it has been proposed to pull the tubing and install so-called "workover" valves beneath the pumps. However, these valves ordinarily can be opened and closed only by wireline manipulations, which of course would require either removing the rod pumps or adding costly and complicated fluid by pass arrangements in the tubing.

Another possibility, of course, is to install a production packer beneath the pump and a surface controlled valve beneath the packer. This would protect the casing and also provide subsurface control over the well without removal of the pump. Preferably, these valves would be safety valves such as that above described wherein a flow tube is urged downwardly to open the flapper by means of hydraulic control fluid supplied to a pressure responsive operator for the flow tube through a control line or conduit extending downwardly from a source of the fluid at the wellhead. As well known in the art, these valves may be permanently mounted in the tubing, or retrievable from the tubing by wire line. Alternatively, as shown in U.S. Pat. No. 4,325,431, the flapper and flow tube may be mounted in the tubing, and an operator for the flow tube disposed within a separate tool removably installed within a pocket to one side of the bore.

Although one possible solution, an installation of this latter type would be bulky and expensive, and thus impractical in "marginal" wells i.e., those in which the level of production justifies only minimal additional costs. This is especially true in view of the possible need for the use of exotic metals and/or the addition of inhibitors to combat the increased corrosion problems. Still further, the pumps in such wells are located at depths considerably greater than those at which safety valves of this type are normally installed. As a result, the spring for urging the flow tube upwardly to permit the flapper to close may not be strong enough to lift the column of hydraulic control fluid in the control line even when exhausted.

As noted above, in conventional safety valves of this type, the flapper is held closed with a large force due to well fluid beneath it, such that it is necessary to first equalize the pressure across the flapper. For this purpose, the valve includes a passageway connecting the bore of the body means or mandrel of the valve above and below the seat for the flapper, and a closure element moveable to a position opening the passageway as the flow tube is lowered by the operator toward a position to open the flapper. Whether these closure elements are opened hydraulically, as in the aforementioned U.S. patent, or mechanically, they are returned to closed position as the flapper is moved to open position. However, as the flapper returns to closed position, the closure element is again opened and closed, resulting in many cases in a blast of high pressure well fluid through the passageway which may damage the closure element and/or the passageway. Also, if sand or other debris has accumulated in the passageway, and particularly on the seat, the closure element may not fully seat. Still further, when the passageway is arranged in a radial direction, it requires considerable annular space to accommodate the stroke of the closure element, so that the diameter of the overall valve may be too large for many installations, and, in any case, larger than would be required in the case of a similar valve having an axially stroking closure element.

It is therefore one object of this invention to provide apparatus for controlling such wells whose operation does not require wireline manipulation, or costly bypass arrangements, but which is of compact and inexpensive construction.

Another object is to provide such apparatus which also provides surface controlled, fail safe protection for the well.

A still further object is to provide such apparatus which enables seals, springs and other parts subject to damage to be easily retrieved with the downhole pump.

Still another object is to provide a subsurface, surface controlled safety valve of the type described which is particularly well suited for use at depths greater than those ordinarily encountered.

Yet a further object is to provide a subsurface, surface controlled safety valve of the type described in which pressure across the closure member may be equalized without risking damage to the equalizing valve, without substantial increase in the radial dimension of the valve, and with the assurance that the equalizing valve will close despite the presence of sand or other debris in the well fluid.

These and other objects are accomplished, in accordance with the illustrated embodiment of the invention, by well apparatus of the type described including a lower tubular body having a bore therethrough and adapted to be lowered into the well bore, packer means and anchor means carried about the lower body and adapted to be expanded into sealed and anchored positions, respectively, with the well bore, when the lower body is disposed in a desired position therein, and a flapper mounted on the body for pivoting between positions opening and closing the bore therein and yieldably urged to closed position. The apparatus also includes an upper tubular body having a bore therethrough and adapted to be lowered into the well bore and supported on the lower body with its bore forming a continuation of the bore through the upper body and a lower continuation of the lower end of the well tubing suspended within the well bore, means for releasably connecting the upper body to the lower body when so supported, and a flow tube extending longitudinally within the bores of the upper and lower bodies and through the packer and anchor means, when the bodies are so connected, for reciprocation between an upper position in which its lower end is above the flapper to permit it to close and a lower position in which its lower end moves the flapper to open position. More particularly, a means is provided on the upper body for moving the flow tube between its upper and lower positions which includes piston means responsive to the supply thereto of hydraulic control fluid from a remote source for moving the flow tube toward one of its positions. Hence, both the tubing and the casing are protected, and the tubing is firmly anchored in the well bore, by apparatus which is relatively compact and inexpensive since the packer and anchor means and the subsurface valve are arranged essentially axially coextensive of one another, rather than in end to end relation. Also, the release and retrieval of the upper tubular body with the downhole pump permits the flapper to close and thereby automatically shuts in the well.

In the preferred and illustrated embodiment of the invention, the valve is a safety valve wherein means are provided for yieldably urging the flow tube toward its upper position and the flapper toward closed position, and the hydraulic operator is arranged to move the flow tube toward its lower position, whereby the flapper closes automatically in response to the exhaustion of control fluid. Also, the upper end of the flow tube is telescopically slidable with respect to the body means to form an annular space between the flow tube and the bores of the body means formed by the interconnected upper and lower bodies in which the spring is received and axially compressed between the flow tube and upper body to urge the flow tube to its upper position, and a means is provided in the upper body through which inhibitor fluid may be introduced into the upper end of the annular space, so as to circulate downwardly through the space, and thus the spring and the packer and anchor means, and upwardly within the flow tube and out the upper end of the bore of the upper body. Since the space is above the packer means, the walls of the flow tube and body means which form the space need not contain a pressure differential and thus may be relatively thin so as to allow for as large a space for the spring as possible without increasing the diameter of the body means.

More particularly, there is a seat in the lower body beneath the flapper and on which the flow tube is seatable in its lower position, and an opening in the lower body means beneath the flapper seat through which inhibitor fluid may circulate from the annular space about the flow tube and into the annulus about the lower body, and downwardly about a tail pipe on the lower end of the lower body before flowing through lower end of the tail pipe and into the flow tube. Thus, it is possible not only to circulate the inhibitor fluid past essentially all of the working parts of the apparatus, but also within much of the casing beneath the packer means.

In the illustrated and preferred embodiment of the invention, the means by which the flow tube is urged to its lower position includes a cylinder mounted on the upper end of the upper body to one side of the bore therethrough, a piston reciprocable within the cylinder and having a rod engageable with the flow tube, and port means in the body means leading to the cylinder and to which a control line may be connected in order to supply hydraulic control fluid to the piston to urge the flow tube to its lower position. Thus, as compared with more conventional safety valves, the pressure responsive operator for the flow tube has a relatively small area, so that there is a correspondingly smaller volume of control fluid which must be lifted by the spring in order to raise the flow tube and thus permit the flapper to close. Preferably, a port is formed in the upper body to connect the bore therethrough above the flow tube with the exterior of the upper body, whereby, during pumping of well fluid, the well fluid may pass into the annulus above the packer means, where gas is permitted to break out from the well fluid prior to being pumped upwardly through the tubing.

In its preferred form, the safety valve further includes a means for equalizing pressure across the closed flapper which comprises a passageway formed in the lower body to connect the bore above and below the seat for the flapper, a closure element mounted on the lower body for movement between positions opening and closing the passageway and yieldably urged by spring means to closed position, and means on the flow tube for movement therewith in one direction to move the closure element from closed to open position and then release it for movement from open to closed position as the flapper is opened. As compared with prior safety valves of this type, the closure element is retained in closed position upon upward movement of the flow tube, when control fluid is exhausted to permit the flapper to move to closed position, whereby well fluid cannot jet through the passageway as the flapper closes. Thus, the flow tube and closure element have detent means which are engageable with one another to move the closure element to open position, as the flow tube is lowered, toward a position to open the flapper, and disengageable from one another to permit the closure element to close, as the flow tube continues to move in such one direction to open the flapper, but which are engageable and disengageable from one another as the closure element remains closed, to permit the flow tube to move to its upper position. As illustrated, the passageway extends longitudinally within the body means and has a seat thereabout, and the closure element has detent means thereon above the passageway which is engageable by the detent means on the flow tube. More particularly, there are a plurality of passageways and closure elements and the detent means includes a ring in position to be engaged by the radially expandable and contractible collet means on the flow tube.

Figure 8:
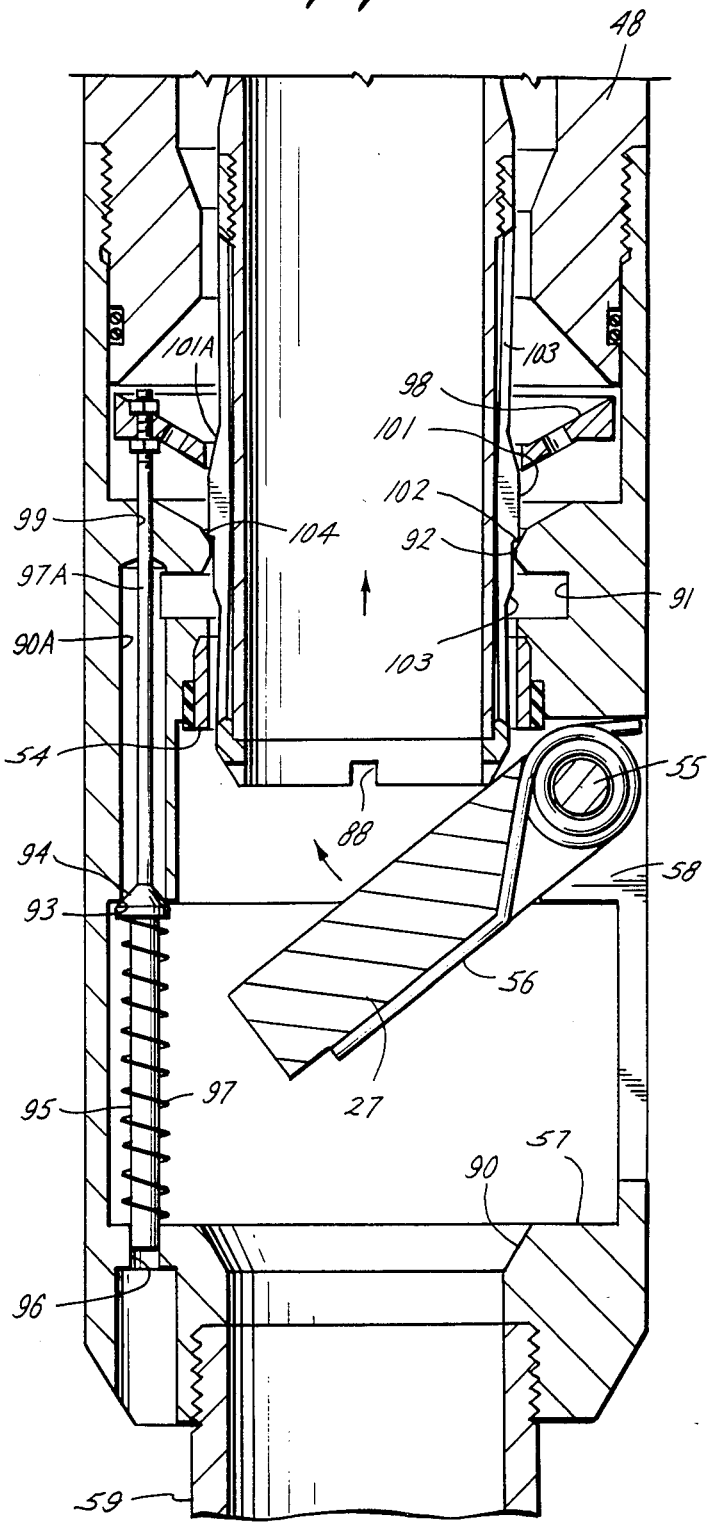
Figure 2A:
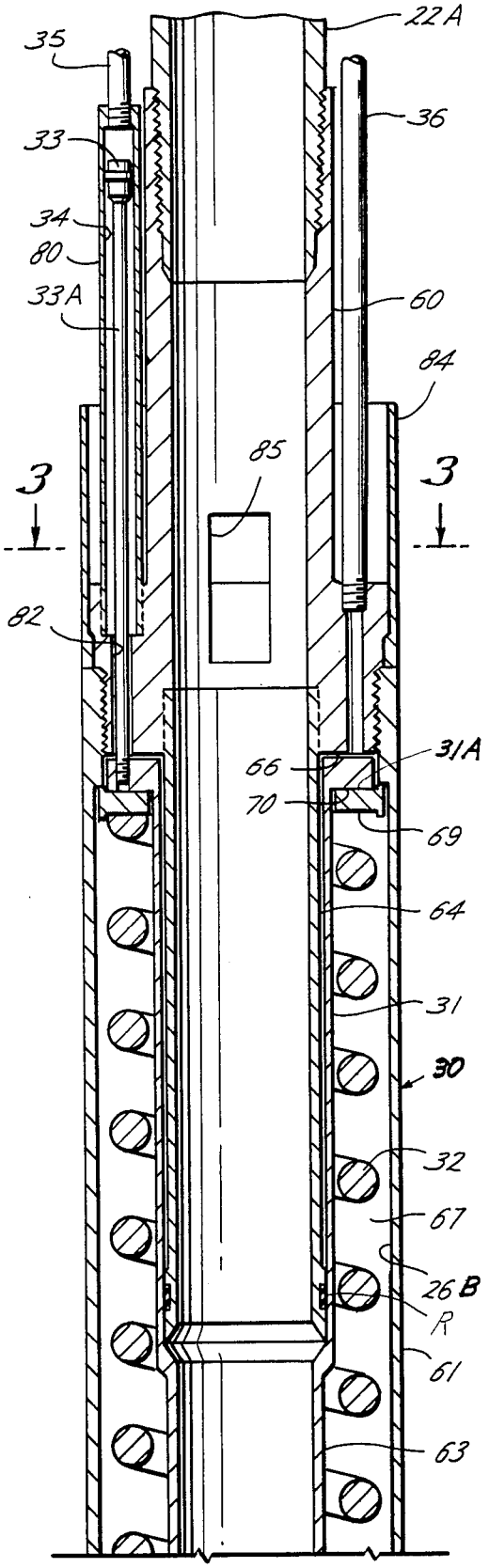
Figure 2B:
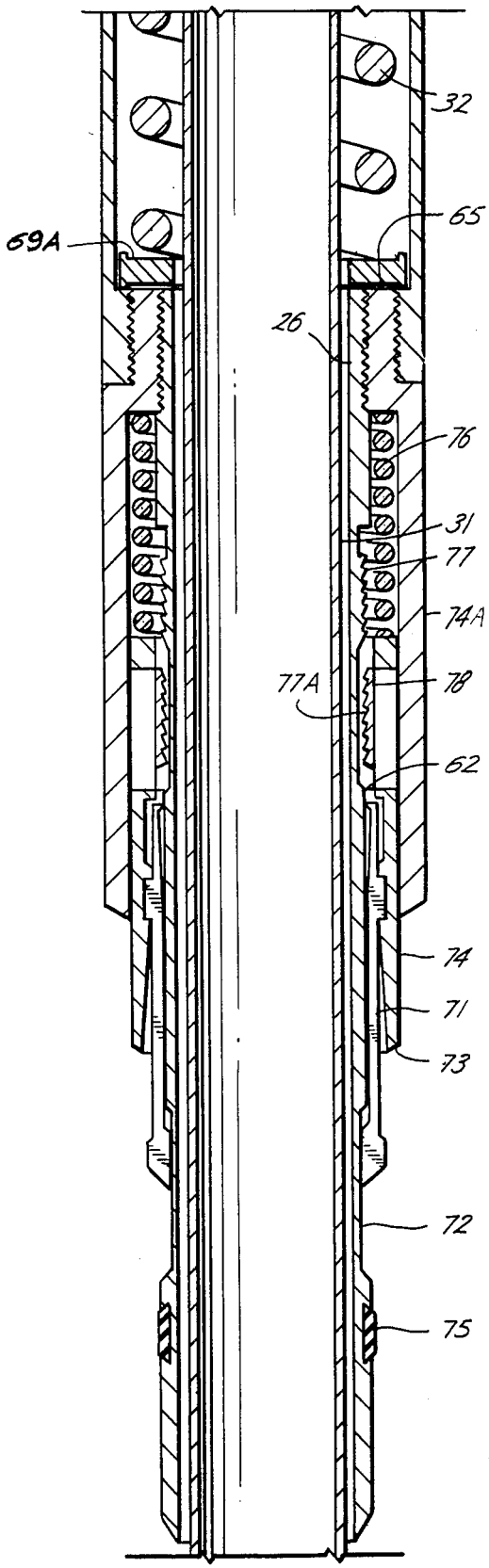
Figure 2C:
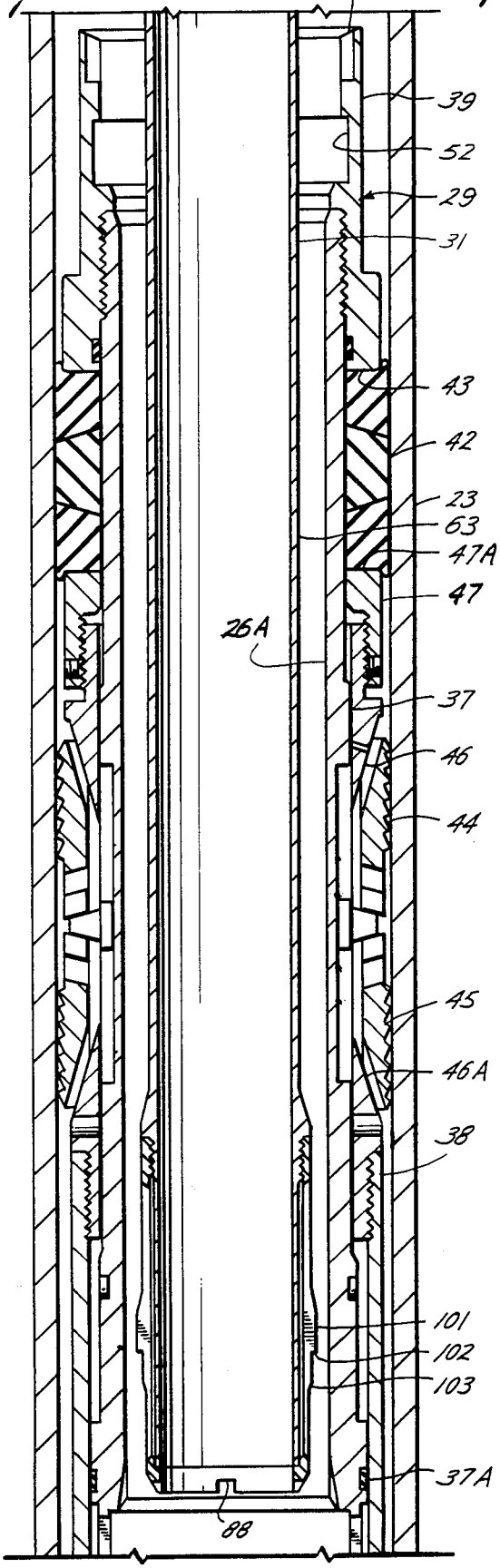
Figure 2D:
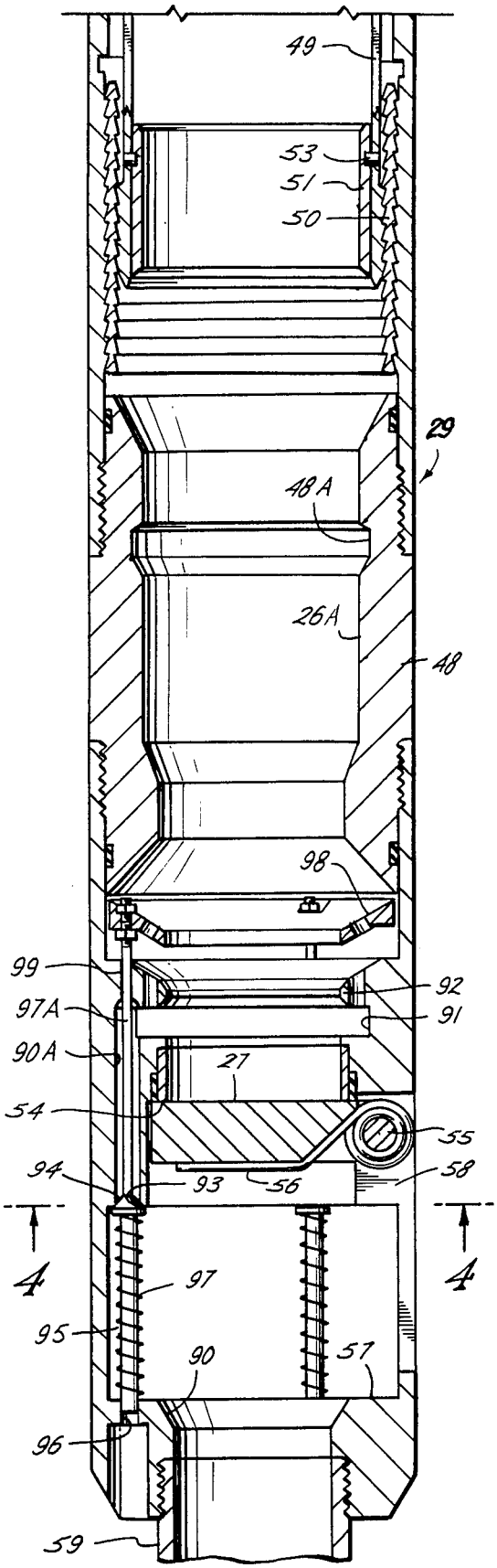
Figure 5A:
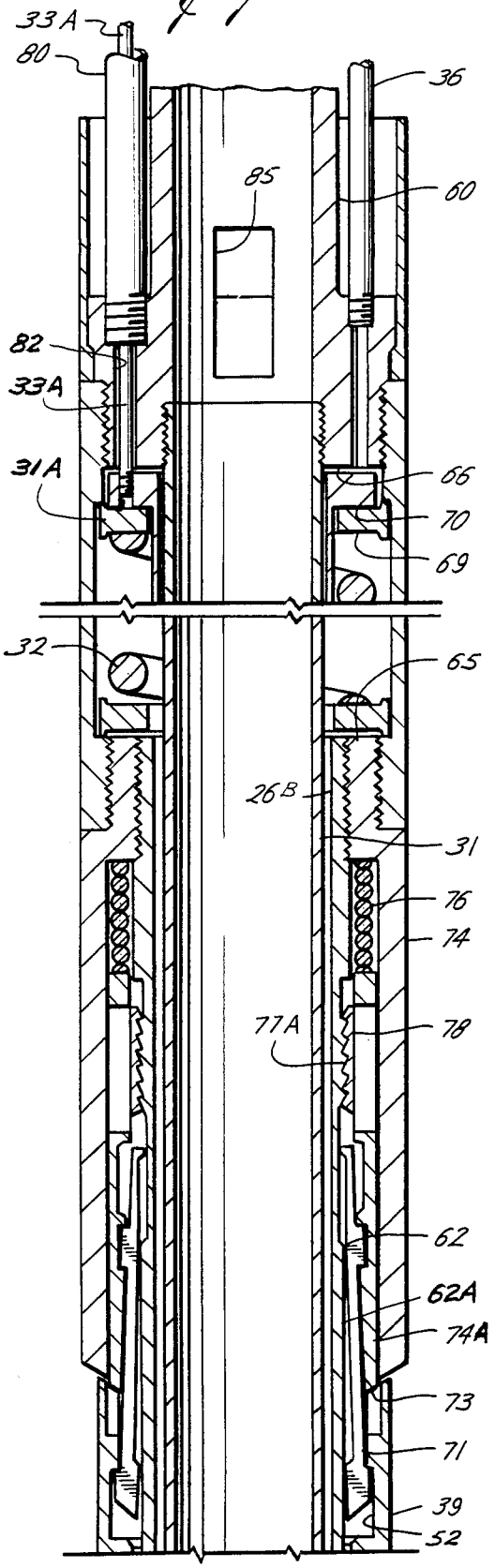
Figure 3:
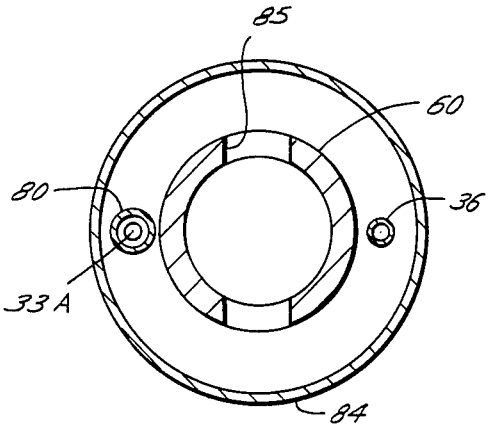
Figure 4:
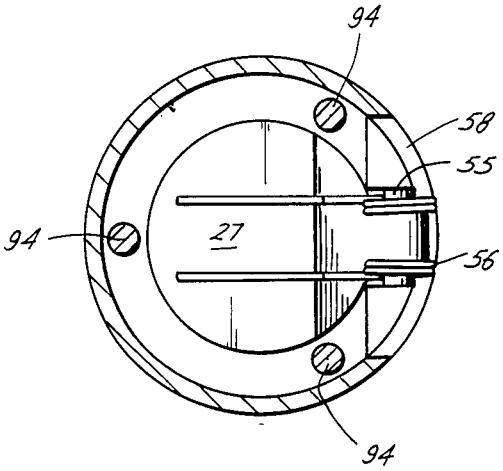
Figure 5B:
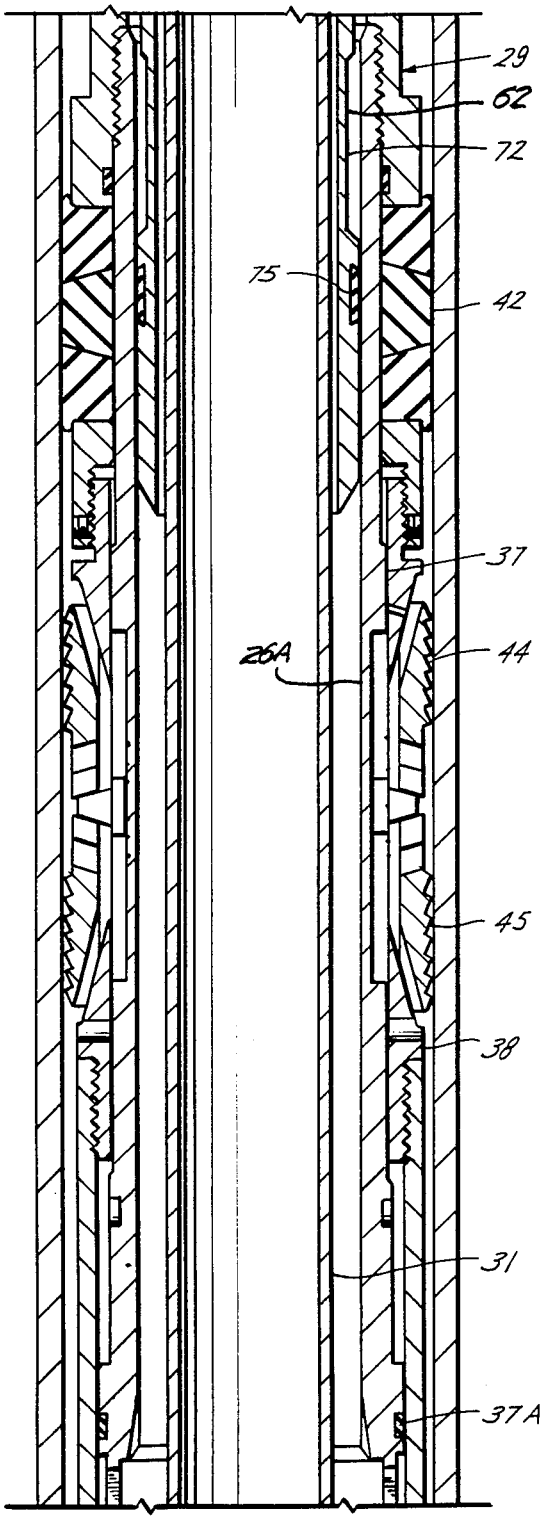
Figure 5C:
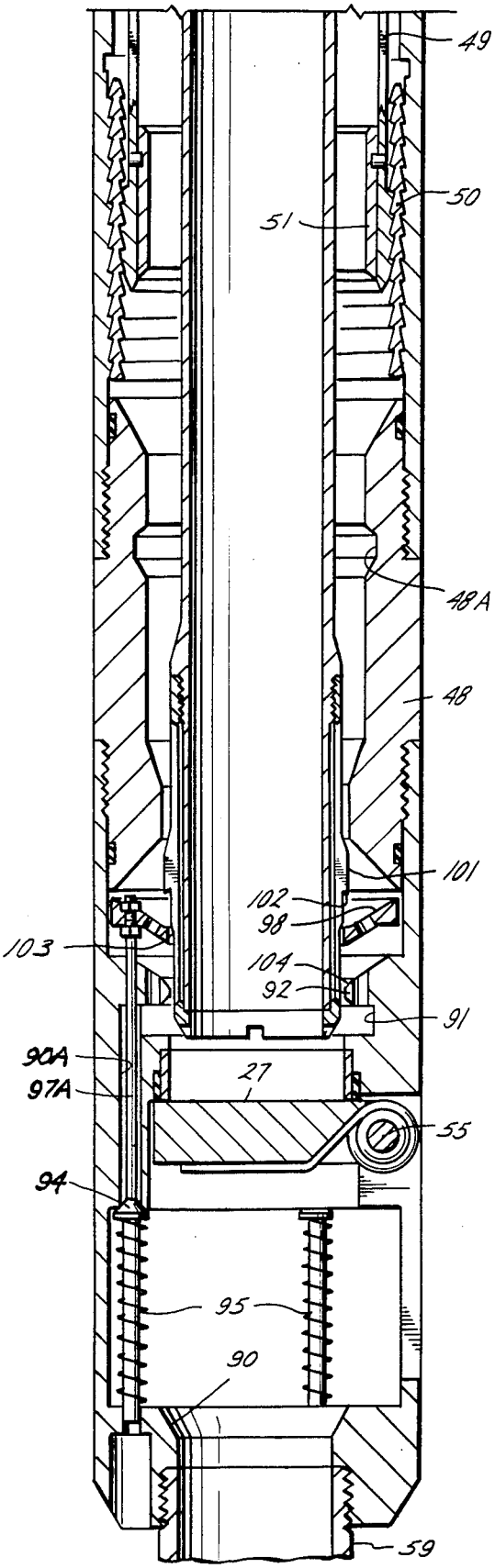
Figure 6A:
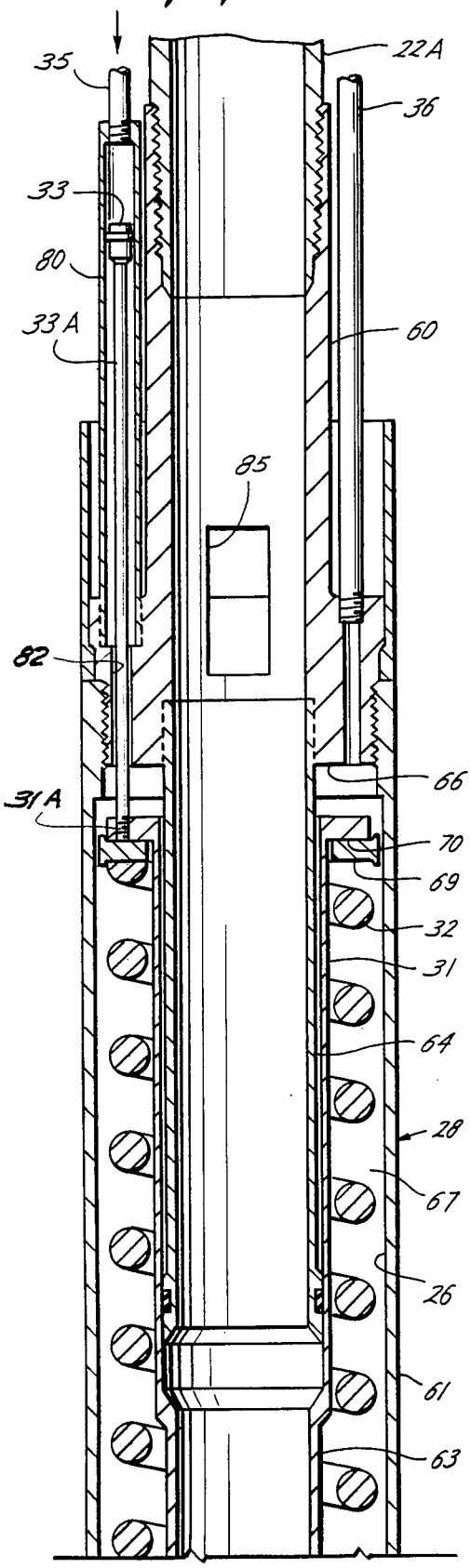
Figure 7A:
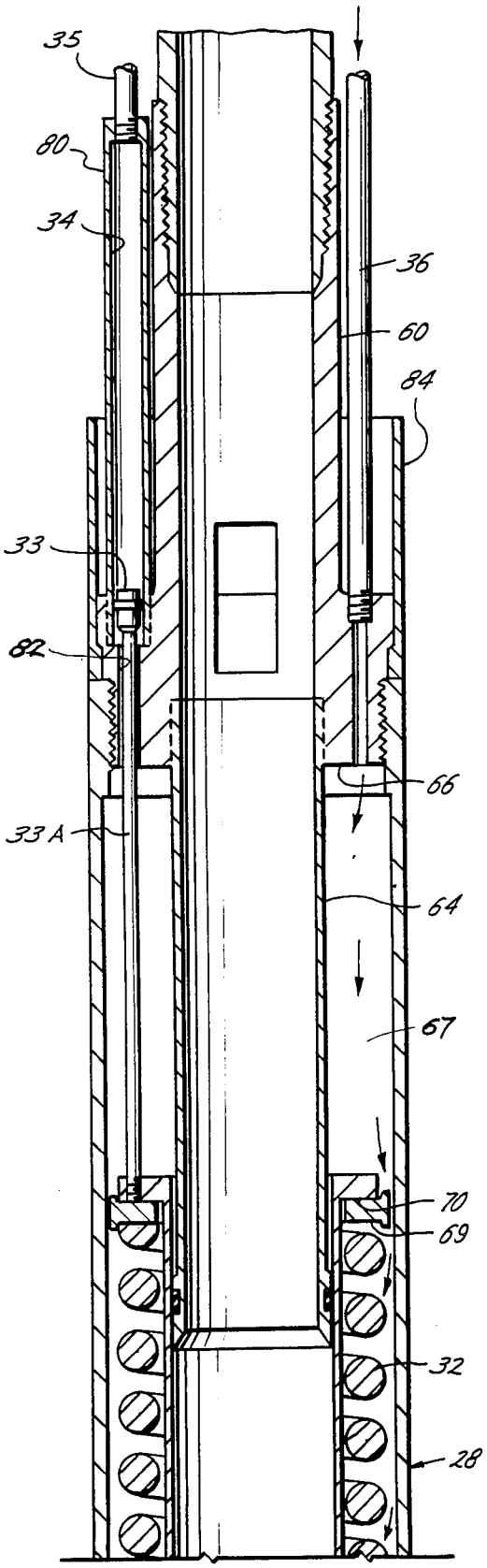
Figure 6B:
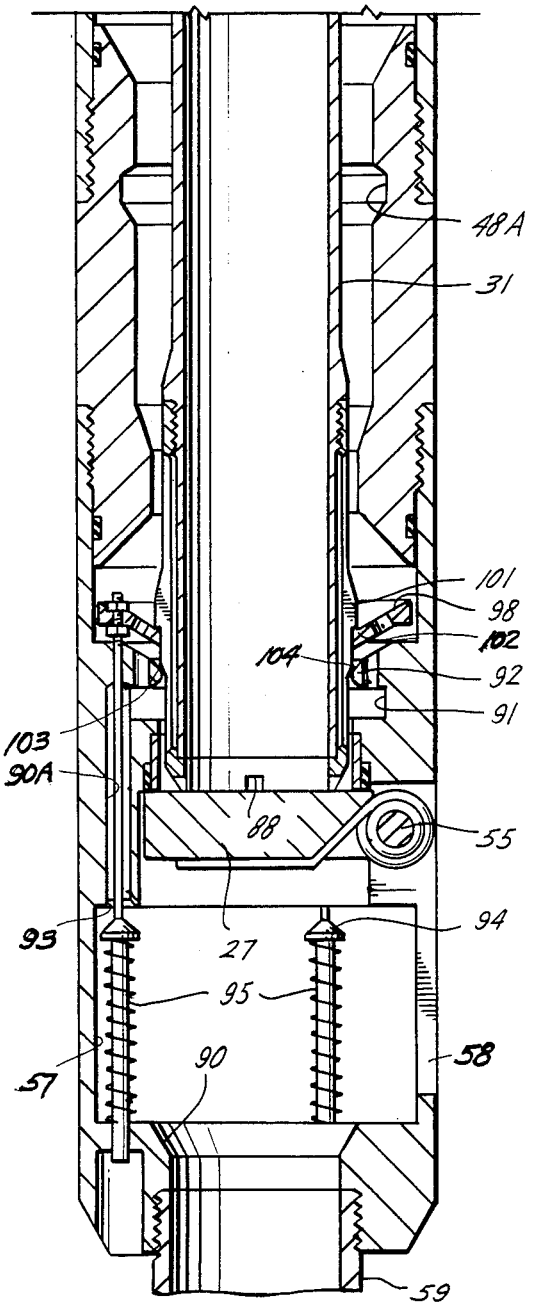
Figure 7B:
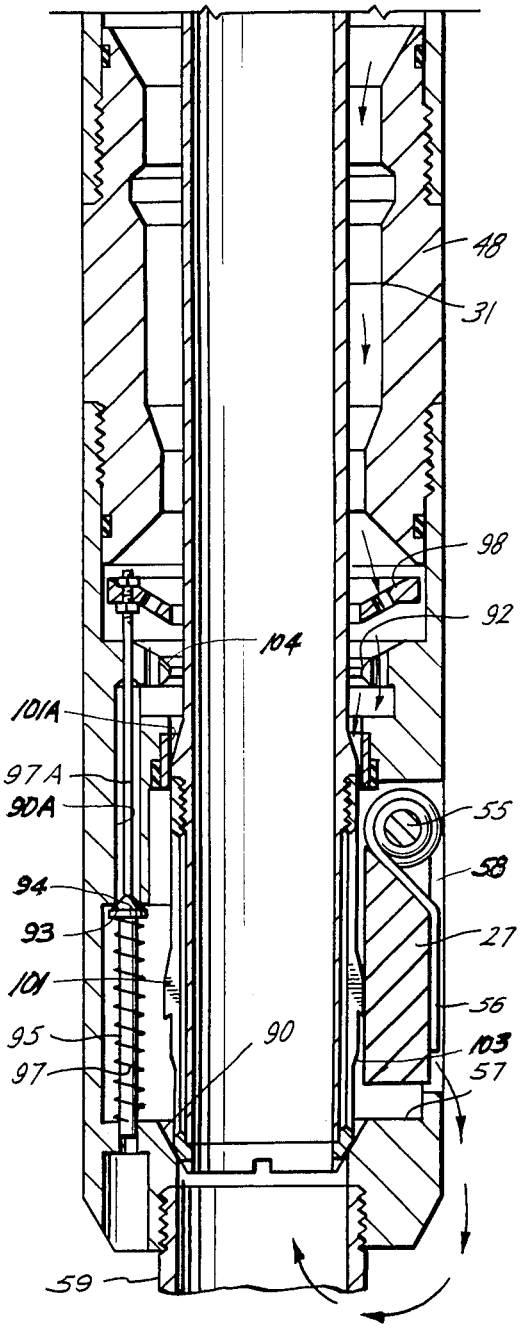

In the drawings, wherein like reference characters are used to designate like parts:

In FIG. 1 a diagramatic, vertical sectional view of the overall apparatus connected at the lower end of a tubing in which a sucker rod type pump is installed, and showing the flapper closed;

FIGS. 2-A to 2-D are enlarged vertical sectional view of successively lower portions of the apparatus, with the upper tubular body of the body means in the process of being raised from the lower tubular body which is packed off and anchored within the well casing:

FIGS. 3 and 4 are cross-sectional views of the apparatus, as seen along broken lines 3—3 of FIG. 2-A and 4—4 of FIG. 2D, respectively;

FIGS. 5A to 5C are also vertical sectional views of vertically successive portions of the apparatus, similar to FIGS. 2A to 2D, but upon lowering of the upper tubular body of the body means into connection with the lower tubular body thereof, and with the flow tube raised to permit the flapper to be moved to closed position;

FIGS. 6A and 6B are further vertical sectional views of the upper and lower ends of the apparatus, similar to FIGS. 5A and 5C, but upon lowering of the flow tube into engagement with the upper end of the closed flapper, in response to the supply of hydraulic control fluid to the operator for the flow tube, and lowering of the closure elements of the equalizing valve means to open positions so as to equalize pressure across the flapper;

FIGS. 7A and 7B are vertical sectional views similar to FIG. 6A and 6B, respectively, but upon further lowering of the flow tube to its lower position to move the flapper to open position, and showing by arrows the circulation of inhibitor fluid through the annular space between the flow tube and the bore of the body means as well as out of the body means and into its lower end and the flow tube; and FIG. 8 is a further enlarged, vertical sectional view of a portion of the apparatus, including the flapper intermediate its opened and closed positions.

With reference now to the details of the above described drawings, the overall apparatus, which is indicated in its entirety by reference character 20, is shown in FIG. 1 to be connected to the lower end of a well tubing 21 which extends downwardly within casing 23 which lines the well bore. The tubing is suspended from a wellhead (not shown) installed at the upper end of the well bore, and a sucker rod type pump 22 is installed in the lower end of the tubing in order to pump well fluid from formation F at the lower end of the well bore upwardly to the wellhead. The sucker rod pump 22 may be of conventional construction including standing and traveling valves adapted to be raised and lowered in response to reciprocation of a sucker rod 24.

The apparatus 20 is shown in FIG. 1 to include an upper tubular body means 30 having a bore 26B therethrough connected to and forming a lower continuation of the housing of pump 22, a lower tubular body 29 also having a bore 26A therethrough and to which the upper body is releasably connected to form a body means having an open lower end. A flapper 27 is mounted on the lower body for opening and closing the bore 26A, and anchor and packer means 28 are carried about the lower body and adapted to be moved into anchored and packed off relation within the well bore so as to close off the annulus about the well tubing above the formation. The upper tubular body 30 has a lower end which fits within the upper end of the lower body and is releasably connected to the lower body 29 by locking means 29A, and a packing 29B carried about the upper body seals with respect to bore 26A of the lower body when the bodies are so connected.

As also shown diagramatically in FIG. 1, a flow tube 31 is mounted within the upper body for extension downwardly from the lower end and into the bore of the lower body and through the packer and anchor means for reciprocation between an upper position of FIG. 1, in which the flapper 27 is urged to closed position, and a lower position in which the lower end of the flow tube moves the flapper to open position. The flow tube is yieldably urged to its upper position by means of a coil spring 32 which is contained within an annular space between the flow tube and the upper end of the bore through the upper body and compressed between the upper body and flange 31A about the upper end of the flow tube, and is adapted to be moved to its lower position by an operator which includes a piston 33 sealably reciprocable within a cylinder 34 mounted on the upper tubular body to one side of its upper end. The piston has a rod 33A which extends downwardly for engagement with the flow tube flange 31A and is thus urged upwardly by the spring 32, and control fluid is adapted to be supplied to the upper end of the piston to lower the flow tube, and thus open the flapper, through a control line 35 extending within the annulus of the well for connection at its upper end to a source of such fluid at the well head. As previously described, upon exhaustion of the control fluid, the springs 32 urge the flow tube to the upper position of FIG. 1.

As also shown diagrammatically in FIG. 1, a conduit 36 extends downwardly within the annulus to connect at its lower end with the annular spring space in order to circulate inhibitor fluid from a source at surface level past the spring 33 and downwardly with an annular space between the flow tube and the bores through the upper and lower bodies, and then, as will be described in detail, into the annulus about the lower body means into the lower end of the lower body and upwardly through the flow tube.

The lower tubular body 29 is shown in each of FIGS. 2C and 2D to comprise an upper tubular member 37 about which the packer and anchor means 28 are carried for expansion into the engagement with the casing 23, upon lowering of the lower body into a desired position therein, and a lower tubular member 38 which surrounds the lower end of the upper member beneath the packer and anchor means. More particularly, the upper member telescopes within the lower member and carries a seal ring 37A thereabout for sealably engaging the lower tubular member as they are moved longitudinally relative to one another beneath position to expand the packer and anchor means 28 or, alternatively, permit it to be unset in order to retrieve the lower body from the well bore.

As shown, the tubular members 37 and 38 and the packer and anchor means carried thereabout make up a packer assembly similar to that shown and described in U.S. Pat. No. 4,393,929, assigned to the assignee of the present invention, except for the fact that it is adapted to be set mechanically rather than by the hydraulically responsive mechanism shown in such patent. Thus, it includes a packing element 42 surrounding the upper tubular member 37 beneath a shoulder 43 formed on the lower end of a neck 39 at the upper end of member 37, and upper and lower slip assemblies 44 and 45 which also surround the upper tubular member beneath the packing element. More particularly, the upper and lower slip assemblies have conical inner surfaces which are slidable over conical expander surfaces 46 and 46A, respectively, formed on member 47 and the upper end of lower tubular member 38, respectively. Expander member 47 has an upper shoulder 47A on which packing elements 42 are supported and is adapted to move longitudinally toward and away from the tubular members as the packer is set and reset. As shown in FIG. 2D, the lower tubular member 38 extends downwardly to connection with an intermediate tubular member 48 of the lower body 29 on which flapper 27 is mounted.

The upper tubular member 37 has collet fingers 49 at its lower end beneath seal rings 37A on which rachet teeth are formed thereon for engaging rachet teeth formed on the inner surface of lock ring 50 mounted on the inner diameter of the lower tubular member 38. More particularly, and as will be understood from U.S. Pat. No. 4,393,929, the outer diameter of the body lock ring has cam teeth engageable with cam teeth on the inner side of the lower tubular member, and a ring 51 is releasably connected by shear pin 53 to the collet fingers within their lower ends. Thus, the lower member is supported from the upper member and the lock ring is free to expand and contract as the collet fingers rachet downwardly thereover.

Thus, the lower body 29 is lowered into place within the casing 23 with the upper tubular member 39 in a raised position with respect to the lower tubular member 38, and thus with packing element 42 and upper and lower slip assembly 44 and 45 in retracted or unset positions. When the body 29 has been so lowered, the upper member is moved downwardly with respect to the lower member to cause the rachet teeth on collet fingers 49 to move downwardly over the rachet teeth on body lock ring 50, and thereby lower shoulder 43 with respect to shoulder 47A, to expand the packing element and lower expander member 47 to move expander surfaces 46 and 46A toward one another so as to wedge both the slip assemblies into anchored engagement with the casing 23. The rachet teeth will hold the packer set until such time that pin 53 connecting ring 51 to the collet fingers is sheared and the ring is moved upwardly to permit the collet fingers to move radially inwardly, and thus enable the upper tubular member to be raised with respect to the lower tubular member to permit the packing element 42 to contract and the slip assemblies 44 and 45 to be withdrawn, whereby the lower body may be retrieved from the well bore. The upper and lower tubular members are moved vertically toward contracted positions by means of a tool (not shown) lowered within the bore 26A and having relatively axially moveable members respectively engageable with an upper locking groove 52 in the neck 39 and a lower locking groove 48A in the intermediate tubular member 48.

As shown in FIG. 2D, the bore through the intermediate tubular member 48 is reduced intermediate its upper and lower ends to provide a downwardly facing seat 54 against which the flapper 27 moves to close the bore. More particularly, the flapper is pivotally mounted on a lower extension of tubular member 48 by means of a pin 55 so that it may swing between a generally horizontal position, as shown in FIG. 2D wherein it is disposed across the seat 54 to close the bore 26A, and the position shown in FIG. 7B wherein it is swung downwardly, in a manner to be described, so as to open the bore. As previously described, the flapper is yieldably urged toward its closed position as by means of a torsion spring 56 which surrounds the pivot pin and has a lateral extension connected to the lower side of the flapper, and the tubular member 48 has a recess 57 formed in one side thereof to receive the flapper in its open position. More particularly, and as previously described and for a purpose to be discussed more fully herein after, an opening 58 is formed in the outer wall of the recess to connect the bore through the tubular member 48 of the lower body with the annulus about the lower body. As shown in FIG. 2D, a tail pipe 59 is connected to the lower end of tubular member 48 for extension downwardly therefrom to a level at least near the lower end of the producing formation F (See FIG. 1).

As shown in FIG. 2A and 2B, the upper tubular body 30 includes an upper tubular member 60 having an upper end threadedly connected to the lower end of the housing 22A of the pump 22, and a lower end threadedly connected to the upper end of an intermediate tubular member 61 which extends downwardly to threaded connection with a lower tubular member 62. As previously described, flow tube 31 is mounted within the bore 26B of the upper body and has a lower end which depends from the upper body for extension into the bore 26A of the lower body 29 as the upper body is lowered into connection with the lower body. More particularly, the flow tube is mounted on the upper body for reciprocation between an upper position, as shown in FIGS. 2A, 5A, and 6A, and a lower position, when the bodies are connected, in which its lower end moves the flapper 27 to open position and holds it in open position, as shown in FIGS. 7A and 7B, as will be described.

As shown in FIGS. 2A and 2B, the upper end of the flow tube is telescopically disposed about a lower extension 64 of the inner diameter of the upper tubular member 60 to form an annular space 67 between it and the tubular member 61 in which the spring 32 is contained. Thus, the lower tubular member 62 has an upper end which provides an upwardly facing shoulder 65 opposite a shoulder 66 on a radially enlarged portion of upper tubular member 60 and the coil spring 32 is compressed between rings 69 and 69A vertically reciprocable within the tubular member 61, with ring 69 is disposed beneath the flange 31A about the upper end of the flow tube 31 and ring 69A above shoulder 65, so that the spring will yieldably urge the flow tube to the upper position shown in FIGS. 2A to 2C in which flange 31A is adjacent shoulder 66.

As previously described, the annular space 67 in which the spring 32 will accommodate as large a spring 32 as possible without increasing the overall outer diameter of the apparatus. Thus, since the spring and space are above the packer, there is no pressure differential across them so that the lower extension 64 of the upper tubular member of the upper body as well as the upper end of the flow tube 63, and the tubular member 61 disposed about the spring, may be relatively thin. Although a ring D is shown to be carried by the lower end of the wall 64 for sliding within the inner diameter of the upper end of the flow tube 63, this is merely a wiper ring and not for the purpose of containing pressure.

Although the upper body may be releasably connected to the lower body in any suitable manner, it is preferably locked thereto by means similar to that shown and described in pending patent application Ser. No. 225,395,filed Jan. 15, 1981, entitled "Releasable Latching Apparatus", now U.S. Pat. No. 4,477,104 and assigned to the assignee of this application. Thus, as shown in FIGS. 2B and 5A, locking dogs 71 are carried about the tubular member 62 for pivotal movement between positions in which lugs on their lower ends are withdrawn within a recess 72 about the tubular member 62, as shown in FIG. 2B, to permit them to be lowered into the neck at the upper end of the lower body 29 and opposite groove 53 therein, and in which they are expanded into the groove 52 to releaseably connect the upper body to the lower body as shown in FIG. 5A. As shown in FIGS. 5B and 5C, the lower depending end of the flow tube 31 and the lower end of tubular member 62 move downwardly within the bore 26A of the lower body until a shoulder 73 on the lower end of an annular carrier 74A which is supported from the member 62 lands on an upwardly facing seat 74 of the fishing neck of the lower body, as shown in FIG. 5A, to locate the lugs of the locking dogs 71 opposite the locking groove 52 in head 39. As shown in FIG. 5B, as the member 62 is so lowered, a seal ring 75 carried thereabout beneath the groove 72 sealably engages the bore 26 of the lower body beneath the groove 52 (FIG. 5A), whereby the bores through each of the upper and lower bodies are telescopically and sealably arranged to form longitudinal continuations of one another.

The locking dogs 71 are urged downwardly by springs 76 and, as will be understood from a comparison of FIGS. 2B and 5A, are adapted to be moved into locking positions within the groove 52 by continued lowering of the member 62 of the upper body, following landing of shoulder 73 on seat 74, to cause a cylindrical surface 62A on the member 62 above the recess to move behind and hold the lugs of the dogs in locking position. At this time, rachet teeth 77 on the outer diameter of member 62 engage rachet teeth 77A on the inner sides of latches 78 which are mounted for radial movement on carrier 74A so as to latch member 62 in locking position. As described in detail in the aforementioned patent application, this locking mechanism is releasable upon rotation of member 62 to disengage teeth 77 from teeth 77A so as to permit member 62 to be raised and thereby release the lugs on the locking dogs for movement out of groove 52.

As shown in FIG. 5C, the flow tube is of such length that when the upper body is connected to the lower body, and the flow tube is maintained in its upper position by means of the coil spring 32, the lower end of the flow tube is spaced above the upper side of the closed flapper 27. The flow tube is then urged downwardly so as to move the flapper to the open position of FIG. 7B by means of a hydraulic operator mounted on the upper tubular member 60, and comprising a tube 80 threadedly connected to the upper enlarged end of hole 82 formed in the enlarged diameter lower end of the body 60 (see FIGS. 2A, 5A, 6A and 7A) so as to form the cylinder 34 (FIG. 1) connecting with the annular space 67. As also previously described in connection with FIG. 1, a piston 33 is sealably reciprocable within the cylinder and has a rod 33A extending downwardly therefrom and through the hole 82 to connect with the flange 31A on the upper end of the flow tube so that the flow tube is adapted to be lowered in response to downward movement of the piston 33. As the flow tube moves downwardly, of course, its flange 31A will bear upon the ring 69 so as to compress the spring 32 which yieldably urges the flow tube to its upper position, as shown in FIG. 7A.

As also previously described in connection with FIG. 1, and shown in FIGS. 6A and 7A, a conduit 35 is threadedly connected at its lower end to the upper end of the cylinder 34 and is adapted to extend upwardly within the annulus of the well bore to a source of hydraulic control fluid under pressure at the wellhead. Thus, when the upper body has been lowered into connection with the lower body, control fluid under pressure may be supplied to the cylinder 34 for lowering the piston 33 and thus the flow tube 31 so as to move the flapper to its open position and hold it in open position, as shown in FIG. 7B. Alternatively, when the control fluid is exhausted, for whatever reason, spring 32 urges the flow tube back to the upper position (FIGS. 2A, 5A and 6A), in which its lower end is lifted above the flapper to permit the flapper to be urged by spring 56 to the closed position of FIG. 5C. Thus, as previously described, the well will be shut in the event it is necessary or desirable to release and raise the upper body from the lower body for the purpose of retrieving the pump for repair or replacement. At the same time, retrieval of the upper body permits retrieval of the operator and thus the seal about the piston as well as the spring 32 for replacement or repair, as needed.

As previously mentioned, and as shown in each of FIGS. 2A and 5A, one or more holes 85 are formed in the upper tubular member 60 of the upper body 30 to connect the bore through the tubular member with the exterior of the body, and thereby permit well fluid which may be entrained with $C0_2$ or other gas to flow out into the annulus above the packer before being pumped upwardly through the pump 22. Thus, gas is able to break out from the well fluid in the reservoir which is formed in the annulus above the packer before it is pumped upwardly through the tubing, which makes the pump much more efficient. Furthermore, the provision of this hole obviates the need for a special tool which might otherwise be required to provide this communication between the bore beneath the pump housing and the annulus above the packer.

Although, as shown in FIG. 3, there is only one piston 33 and cylinder 34 making up the operator of the flow tube, this invention contemplates that there may be more than one, depending on the ability of the spring 32 to lift the column or columns of hydraulic control fluid therein upon exhaustion of same. As also shown in FIG. 2A and 5A, and as previously indicated in connection with FIG. 1, inhibitor is adapted to be circulated downwardly through the conduit 36 from a source at the wellhead into and through the annular space 67 in which the spring 32 is contained, and then downwardly within the annular space between the flow tube and the aligned bores of the upper and lower bodies. An upwardly extending skirt 84 on the upper tubular member surrounds the tube 80 in which the cylinder is formed, as well as the lower end of conduit 36, at least for a substantial portion of their lower ends, so as to protect their connections to the upper body.

As shown in FIGS. 2D, 5C, 6B and 7B a seat 90 is formed in the lower member of the lower body and beneath the side opening 58 in position to be engaged by the lower end of the flow tube when the flow tube is lowered to open the flapper, as shown in FIG. 7B. Thus, as indicated by the arrows in that Figure, the inhibitor fluid is caused to circulate from the end of annular space out through opening 58 and downwardly within the annulus about the tail pipe 59, and thus past a substantial portion of the casing 23 (FIG. 1) before passing into the lower end of the tail pipe and then upwardly through the flow tube.

The means by which pressure across the flapper 27 is equalized, so as to permit the flapper to be opened upon lowering of the flow tube despite the pressure of well fluid acting upwardly against the closed flapper, includes a plurality of passageways 90A formed in the lower tubular member of the lower body to connect with the bore therethrough above and below the flapper seat 54. More particularly, these passageways are shown to extend vertically parallel to the axis of the bore, with the upper end of each connecting with an annular recess 91 beneath an annular rib 92 on the bore of the lower member, and the lower end of each connecting with the annular recess 57 which receives the flapper when open. More particularly, a conical closure element 94 is adapted to reciprocate between positions opening and closing a seat 93 about the lower end of each passageway so as to respectively connect and disconnect the bore above and below the flapper. A rod 95 extends downwardly from the closure element and has its lower end guidably received within a hole 96 (FIG. 8) formed in the lower end of recess 57, and the closure element 94 is yieldably urged upwardly to closed position by means of a coil spring 97 surrounding the rod and compressed between the lower surface of the recess 57 and the lower side of the closure element.

Each closure element includes another rod 97A which extends upwardly and loosely through the passageway 90A, and a ring 98 connected to the rods and adapted to reciprocate with them within an enlarged diameter portion of the bore 26A above the rib 92. The portion of the rod beneath its upper end is guidably received within a hole 99 (FIG. 8) formed in the rib 92, and the outer diameter of ring 98 fits rather closely within the enlarged diameter portion of the bore of the lower body. In the closed position of the closure elements, the ring 98 occupies an upper position above the upper side of the rib 92, and hence the rods 97A are free to move downwardly as the closure elements are moved downwardly to open position.

As also previously described, and as best shown in FIG. 8, the lower portion of the flow tube 31 is provided with a plurality of radially expandable and contractible collet fingers 101 having an enlarged intermediate portion which provides a downwardly facing shoulder 102 of a diameter adapted to engage and lower the ring 98, and thus more closure elements 94 to open position, as the flow tube is lowered toward the position shown in FIG. 6B in which it engages the top side of the closed flapper 27. Thus, even if hydraulic operator for lowering the flow tube does not provide sufficient force to overcome the force of well pressure urging the flapper closed, so that the flow tube's downward movement is temporarily halted, high pressure well fluid is permitted to pass upwardly into the bore above the flapper, and thus equalize pressure thereacross. Slots 88 are formed in the lower end of the flow tube below and inwardly of the conical surface which engages the seat 90 to permit well fluid which passes upwardly through the passageways 90A and into annular space 91 to pass into the lower end of the flow tube despite its engagement with the top side of the closed flapper.

Upon further downward movement of the flow tube below the position of FIG. 6B to open the flapper, and prior to landing of the lower side of ring 98 on the upper side of the rib 92, a second shoulder 103 on the collet fingers 101 below shoulder 102 moves into engagement with a shoulder 104 on the upper side of the rib 92. More particularly, the shoulders 103 and 104 are tapered downwardly and inwardly so that the shoulder 104 will cam collet fingers 101 inwardly to move the shoulder 102 out of engagement with the upper end of the ring 98 to permit the flow tube to continue to move downwardly from the position of FIG. 6B and thus continue to swing the flapper to its open position. At the same time, the release of the collet fingers from the ring 98 permits the ring to be moved upwardly and the closure elements 94 to be returned to closed positions by means of the spring 97, thereby protecting the seat for the closure elements as well as the passageway from damage by the passage of debris therethrough. More particularly, as the collet fingers are cammed inwardly to disengage with the ring 98, the springs 97 are effective to snap the closure elements back to seated position on the seats of the passageways with sufficient force to cause sand particles or the like accumulated on the seat to be broken up, and thereby assure metal to metal sealing contact between the closure element and seat.

As the flow tube moves downwardly to its lower limited position, as shown in FIG. 7B, it not only confines the flow of inhibitor fluid through the lower end of the annular space between the flow tube and the lower body, and out the opening 58, but also is disposed across the flapper to hold it against the force of the spring 56 in its open position within the recess 57. In this open position of the flapper, the inhibitor fluid is caused to circulate in and around the parts of the equalizing valve—namely, the ring 98 and the rods 97A—and about the closure elements 94 and the springs 97.

With closure elements 94 in seated position, the exhaustion of hydraulic control fluid permits the flow tube to be raised by the spring 32 so as to permit the flapper to swing upwardly back toward its closed position. During this time, another shoulder 101A formed on the upper ends of the enlarged collet finger portions 101 engages rib 92 and then the inner diameter of ring 98 to cam the enlarged collet portions 101 inwardly and thus permit the flow tube to be moved past the ring. Since the closure elements are thus maintained closed as the flow tube is returned to its upper position and the flapper is closed, the parts of the equalizing valve are protected from high pressure fluid which might otherwise occur if it were permitted to pass through the passageways 90A during this stage.

As shown, holes are formed both in the ring 98 and the rib 92 so as to facilitate the flow of inhibitor fluid downwardly within the annular space between the flow tube and bore 26A. As also shown, the ring 98 is fixed to the rods 97A so that if the closure elements failed to move upwardly to seated position, when released by the downwardly moving flow tube, the ring will lift the closure members to seated position by shoulder 104 of the flow tube as it moves upwardly.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

I claim:

1. Well apparatus, comprising a lower tubular body having a bore therethrough and adapted to be lowered into a well bore, packer means and anchor means carried about the lower tubular body and adapted to be expanded into sealed and anchored positions, respectively, with the well bore, when the lower body is disposed in a desired position therein, a flapper mounted on the lower body for pivoting between positions opening and closing the bore therethrough, means yieldably urging the flapper toward closed position, and an upper tubular body having a bore therethrough and adapted to be lowered into the well bore and supported on the lower body with its bore forming a continuation of the bore through the lower body and a lower continuation of the lower end of well tubing suspended within the well bore, means for releasably connecting the upper body to the lower body when so supported, a flow tube extending longitudinally within the bores of the upper and lower bodies and through the packer and anchor means, when lower bodies are so connected, for reciprocation between an upper position in which its lower end is above the flapper to permit it to close and a lower position in which its lower end moves the flapper to open position, means on the upper body for moving the flow tube between its upper and lower positions, including spring means yieldably urging the flow tube toward its upper position, piston means responsive to the supply thereto of hydraulic control fluid from a remote source for moving the flow tube toward its lower position whereby said flapper closes automatically in response to the exhaustion of control fluid, and means in the lower body automatically responsive to movement of said flow tube toward its lower position for connecting the bore of the lower body above and below the flapper before the flapper is opened.

2. Well apparatus of the character defined in claim 1, wherein said last mentioned connecting means includes a passageway in the lower body connecting its bore above and below the flapper, valve means for opening and closing the passageway spring means urging the closure means to closed position, and means on the flow tube engageable with the valve means to move it to open position before the flow tube opens the flapper.

3. Well apparatus, comprising a lower tubular body having a bore therethrough and adapted to be lowered into a well bore, packer means and anchor means carried about the lower tubular body and adapted to be expanded into sealed and anchored positions, respectively, with the well bore, when the lower body is disposed in a desired position therein, a flapper mounted on the lower body for pivoting between positions opening and closing the bore therethrough, means yieldably urging the flapper toward closed position, and an upper tubular body having a bore therethrough and adapted to be lowered into the well bore and supported on the lower body with its bore forming a continuation of the bore through the lower body and a lower continuation of the lower end of well tubing suspended within the well bore, means for releasably connecting the upper body to the lower body when so supported, a flow tube extending longitudinally within the bores of the upper and lower bodies and through the packer and anchor means, when the bodies are so connected, for reciprocation between an upper position in which its lower end is above the flapper to permit it to close and a lower position in which its lower end moves the flapper to open position, means on the upper body for moving the flow tube between its upper and lower positions, including piston means responsive to the supply thereto of hydraulic control fluid from a remote source for moving the flow tube toward one of said positions the upper end of the flow tube being telescopically slidable with respect to the upper body to form an annular space between the flow tube and the bores of the upper and lower bodies, the urging means comprising spring means compressed within the annular space, and the upper body including means through which inhibitor fluid may be introduced into the annular space for circulation downwardly therethrough and upwardly within the flow tube when the bodies are connected.

4. Well apparatus of the character defined in claim 3, including a seat in the lower body beneath the flapper and on which the flow tube is seatable in its lower position, and an opening in the lower body connecting its bore beneath the flapper to the annulus about the lower body so that inhibitor fluid may circulate downwardly about the lower end of the lower body and upwardly into the lower end of the lower body and into the flow tube.

5. Well apparatus, comprising an upper tubular body adapted to be supported on a lower tubular body which has been landed and packed off and anchored within a well bore, said upper body having a bore therethrough adapted to form an upper continuation of a bore through the lower body and a lower continuation of the lower end of a well tubing suspended in the well bore, when so supported, a flow tube extending longitudinally within the bore of the upper body and below the lower end to permit it to be lowered into the bore of the lower body, as the upper body is lowered onto the lower body, means for releasably connecting the lower body to the upper body when so supported, means on the upper body for moving the flow tube between upper and lower positions with respect to the upper body including piston means responsive to the supply thereto of hydraulic control fluid from a remote source to move the flow tube toward one of said positions, the moving means including means yieldably urging the flow tube toward its upper position, and the piston means being arranged to move the flow tube toward its lower position, whereby the flow tube is automatically raised to its upper position in response to the exhaustion of control fluid, the upper end of the flow tube being telescopically slidable with respect to the upper body to form an annular space between the bore of the upper body and the flow tube, the urging means comprising spring means within the annular space and compressed between the flow tube and upper body, and the upper body including means through which inhibitor fluid may by introduced into the upper end of the annular space so as to circulate downwardly through the space.

6. Well apparatus, comprising a tubular body having a bore therethrough and adapted to be lowered into a well bore, packer means and anchor means carried about the body and adapted to be expanded into sealed and anchored positions, respectively, with the well bore, a seat about the bore through the body beneath the packer and anchor means, a flapper mounted on the body for pivoting between positions opening and closing the bore through the seat, means yieldably urging the flapper toward closed position, a passageway in the body connecting the bore above and below the seat, valve means for opening and closing the passageway, spring means urging the valve means to closed position, means on the upper end of the body to which another tubular body may be releasably connected with a bore therethrough in axial alignment with the bore through the body, the upper end of the bore of said body being open to receive the lower end of a flow tube mounted on the other body, when connected thereto, for reciprocation between an upper position in which its lower end is above the flapper and a lower end in which it moves the flapper to open position, means on the valve means engageable by said flow tube as it moves toward its lower position for opening said valve means to connect the bore of the body above and below the flapper before the flapper is opened.

7. As in 6, wherein said valve means includes a closure element movable toward and away from a seat on the passageway, a rod extending upwardly from the closure element and through the passageway, means on the upper end of the rod above the passageway in position to be engaged by the flow tube.

8. Well apparatus, comprising a tubular body having a bore therethrough and adapted to be lowered into a well bore, packer means and anchor means carried about the body and adapted to be expanded into sealed and anchored positions, respectively, with the well bore, a seat about the bore through the body beneath the packer and anchor means, a flapper mounted on the body for pivoting between positions opening and closing the bore through the seat, means yieldably urging the flapper toward closed position, a passageway in the body connecting the bore above and below the seat, valve means for opening and closing the passageway, means on the upper end of the body to which another tubular body may be releasably connected with a bore therethrough in axial alignment with the bore through the body, the upper end of the bore of said body being open to receive the lower end of a flow tube mounted on the other body, when connected thereto, for reciprocation between an upper position in which its lower end is above the flapper and a lower end in which it moves the flapper to open position, means automatically responsive to movement of said flow tube toward its lower position for opening said valve means to connect the bore of the body above and below the flapper before the flapper is opened, means yieldably urging said valve means toward closed position, a seat in the bore of the body beneath the flapper and on which the flow tube is seatable in its lower position, and an opening in the body beneath the seat and connecting the bore with the annulus about the body beneath the packer means so that inhibitor fluid may circulate downwardly about the lower end of the body and then upwardly through the lower end of the body into the flow tube.

9. A subsurface safety valve, comprising tubular body means having a bore therethrough adapted to form a continuation of a well string, a seat about the bore, a passageway connecting the bore above and below the seat, a first closure element mounted on the body means for movement between positions opening and closing the bore through the seat, first spring means urging the first closure element to closed position, a second closure element mounted on the body means for movement between positions opening and closing the passageway, second spring means urging the second closure element to closed position, actuator means mounted on the body means and responsive to the supply thereto of hydraulic control fluid from a remote source to move the second closure element from closed to open position, and thereby equalize pressure across the first closure element, and then move the first closure element from closed to open position, and to the exhaust of control fluid therefrom to permit said first closure element to be moved by said first spring means from open to closed position, said second closure element being releasable from said actuator means so that said second closure element may be returned to its closed position by said second spring means, as the first closure element is moved to open position, and said second spring means retaining said second closure element in said closed position, during movement of said first closure member form its open to its closed position upon exhaustion of control fluid from said actuator means.

10. As in 9, wherein said actuator means is movable in one direction to move the first closure element from closed to open position and in an opposite direction to permit said first closure element to close, and said actuator means and said second closure element have detent means which are engageable with one other to move the second closure element to open position, as said actuator means is moved in said one direction, disengageable from one other to permit the second closure element to be moved to closed position, as said actuator means continues to be moved in said one direction, and then engageable with and disengageable from one another as said acutator means is moved in said other direction to permit said second closure element to be retained in closed position.

11. As in 10, wherein the body means is adapted to from part of a well tubing, and the means responsive to hydraulic control fluid includes piston means sealably reciprocable within cylinder means on the body means, and port means in the body means for connection with a conduit connecting with the source.

12. A subsurface safety valve, comprising tubular body means connectible in a well string and having a bore therethrough forming a continuation of the well string, and a seat about the bore, a flapper pivotally mounted on the body means for movement between positions opening and closing the bore through the seat, means yieldably urging the flapper to closed position, a flow tube longitudinally reciprocable within the body means between an upper position in which its lower end is above the flapper to permit it to be closed and a lower position in which it moves the flapper to open position, means yieldably urging the flow tube to its upper position, means including piston means mounted for longitudinal reciprocation on the body means and responsive to hydraulic control fluid supplied from a remote source to move the flow tube toward its lower position, means including a longitudinal passageway in the body means to connect the bore therethrough above and below the seat, a closure element reciprocable within the body means between positions opening and closing the passageway, means yieldably urging the closure element toward its closed position, said closure element having means extending through the passageway and engagable by means on the flow tube to move the closure element downwardly to open position as the flow tube is moved downwardly toward a position to open the flapper, detent means on the flow tube and the closure element above the passageway disengageable from one another to permit the closure element to be returned to closed position, as the flow tube continues to move downwardly to open the flapper, and then reengageable with and disengageable from one another as the flow tube returns to its upper position to permit the flapper to close.

13. As in 12, wherein said detent means on the flow tube includes collet means thereabout having a first shoulder engagable with the detent means on the closure element to move it downwardly to open the closure element, a second shoulder beneath the first shoulder and engagable with the body means, as the flow tube continues to move downwardly, to force the collet means inwardly to permit the first shoulder to move past the detent means on the closure element, and a third shoulder above the first shoulder which is engageable with the body means and the detent means on the closure element to move the collet means inwardly as the flow tube returns to its upper position.

14. As in 12, wherein there are a plurality of passageways in the body means, a plurality of closure elements each for opening and closing a passageway and having a ring surrounding the flow tube, and the detent means on the flow tube is engageable with the ring to move the closure members downwardly.

15. As in 14, wherein the detent means on the flow tube and ring are disengageable from one another to permit the rod to be returned to closed position, as the flow tube continues to move downwardly to open the flapper, and then reengageable and disengageable as the flow tube returns to its upper position to permit the flapper to close.

16. A subsurface safety valve, comprising tubular body means having a bore therethrough adapted to form a continuation of a well string within a well bore, packer means and anchor means carried about the body means and adapted to be expanded into sealed and anchored positions respectively, with the well bore, a flapper mounted on the body means for movement between positions opening and closing the seat, means yieldably urging the flapper to closed position, a flow tube longitudinally reciprocable with the body means between an upper position in which its lower end is above the flapper to permit it to be closed and a lower position in moves the flapper to open position, the upper end of the flow tube being telescopically slidable with respect to the upper end of the body means to form an annular, concentric space between the tube and bore of the body means beneath upper end of the body means and above the packer means, spring means compressed between the flow tube and body means within the space to urge the flow tube toward its upper position, cylinder means on the body means to one side of the upper end thereof, piston means reciprocable within the cylinder means and having means on its lower end extending into the space to engage with flow tube, and port means in the body means leading to the cylinder means and to which a control line may be connected to supply hydraulic control fluid to the piston means to urge the flow tube to its lower position.

17. As in 16, including a port through body means to connect the bore therethrough above the flow tube with the exterior thereof.

18. A subsurface safety valve, comprising tubular body means having a bore therethrough adapted to form a continuation of a well string, a flapper mounted on the body means for movement between positions opening and closing the seat, means yieldably urging the flapper to closed position, a flow tube longitudinally reciprocable with the body means between an upper position in which its lower end is above the flapper to permit it to be closed and a lower position in moves the flapper to open position, the upper end of the flow tube being telescopically slidable with respect to the upper end of the body means to form an annular space between the tube and bore of the body means beneath upper end of the body means, spring means compressed between the flow tube and body means within the space to urge the flow tube toward its upper position, cylinder means on the body means to one side of the upper end thereof, piston means reciprocable within the cylinder means and having means on its lower end extending into the space to engage with flow tube, port means in the body means leading to the cylinder means and to which a control line may be connected to supply hydraulic control fluid to the piston means to urge the flow tube to its lower position, the lower end of the annular space opening to the lower end of the flow tube, and additional port means being formed in the upper end of the body means to connect the exterior thereof with the upper end of the space, whereby inhibitor may be injected downwardly through the additional port means and the annular space and upwardly through the flow tube.

19. For use with a subsurface safety valve which comprises tubular body means having a bore therethrough adapted to form a continuation of a well string, a seat about the bore, a closure element mounted on the body means for movement between positions opening and closing the bore through the seat, spring means urging the closure element to closed position, actuator means responsive to the supply thereto of hydraulic control fluid from a remote source to move the closure element from closed to open position, and to the exhaust of control fluid therefrom to permit said closure element to be moved by said first spring means from open to closed position; apparatus for equalizing pressure across the closure element before it is opened by the actuator means; apparatus including means forming passageway means for connecting the bore above and below the seat, another closure element for movement between positions opening and closing the passageway means, another spring means urging the other closure element to closed position, said other closure element being positioned to be engaged by said actuator means to move it from closed to open position prior to movement of the first mentioned closure element to open position, the other closure element being releasable from said actuator means so that said other closure element may be returned to its closed position by said other spring means, as the first mentioned closure element is moved to open position, and said other spring means retaining said other closure element in closed position, during movement of said first mentioned closure element from its open to its closed position upon exhaustion of control fluid from said actuator means.

20. Apparatus of the character defined in claim 19, wherein said actuator means is movable in one direction to move the first mentioned closure element from closed to open position and in an opposite direction to permit said first mentioned closure element to close, and said other closure element has detent means which are engageable by detent means on the actuator means to move the other closure element to open position, as said actuator means is moved in said one direction, disengageable from one other to permit said other closure element to be moved to closed position, as said actuator means continues to be moved in said one direction, and then engageable with and disengageable from one another as said actuator means is moved in said other direction to permit said other closure element to be retained in its closed position.

21. Apparatus of the character defined in claim 20, wherein the body means is adapted to form part of a well tubing, the passageway means is formed in the body means, and the means responsive to hydraulic control fluid includes piston means sealably reciprocable within cylinder means on the body means and port means in the body means for connection with a conduit connecting with the source.

* * * * *